US010376130B2

(12) United States Patent
Sanders et al.

(10) Patent No.: US 10,376,130 B2
(45) Date of Patent: Aug. 13, 2019

(54) WAREWASHER MACHINE DRYING SYSTEM AND METHOD

(71) Applicant: ILLINOIS TOOL WORKS INC., Glenview, IL (US)

(72) Inventors: Joseph F. Sanders, North Richland Hills, TX (US); Alexander R. Anim-Mensah, Centerville, OH (US); Mary E. Paulus, Sidney, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 170 days.

(21) Appl. No.: 15/298,403

(22) Filed: Oct. 20, 2016

(65) Prior Publication Data

US 2017/0112351 A1 Apr. 27, 2017

Related U.S. Application Data

(60) Provisional application No. 62/244,415, filed on Oct. 21, 2015.

(51) Int. Cl.
*A47L 15/48* (2006.01)
*A47L 15/00* (2006.01)
(Continued)

(52) U.S. Cl.
CPC ..... *A47L 15/486* (2013.01); *A47L 15/0034* (2013.01); *A47L 15/0076* (2013.01); *A47L 15/241* (2013.01); *A47L 15/488* (2013.01); *A47L 15/4291* (2013.01); *A47L 15/483* (2013.01); *A47L 2401/04* (2013.01); *A47L 2401/17* (2013.01); *A47L 2401/18* (2013.01); *A47L 2401/19* (2013.01);
(Continued)

(58) Field of Classification Search
None
See application file for complete search history.

(56) References Cited

U.S. PATENT DOCUMENTS 4,553,695 A * 11/1985 Grant ..... F23N 3/045 236/51
4,561,904 A 12/1985 Eberhardt, Jr.
(Continued)

FOREIGN PATENT DOCUMENTS

DE 202004020355 8/1977
EP 2215953 A1 * 8/2010 ..... A47L 15/241
FR 2337536 8/1977

OTHER PUBLICATIONS

PCT, International Search Report and Written Opinion, International Application No. PCT/US2016/057858; dated Dec. 14, 2016, 11 pages.

*Primary Examiner* — Rita P Adhlakha
(74) *Attorney, Agent, or Firm* — Thompson Hine LLP

(57) ABSTRACT

A warewash machine for washing wares includes a chamber for receiving wares, the chamber having at least one wash zone with an associated spray system for spraying liquid onto wares passing therethrough, wherein a downstream drying zone includes a blower for blowing air onto wares passing therethrough. The blower includes an ambient intake operatively connected to an ambient air flow path, a machine intake operatively connected to an internal machine air flow path and an exhaust intake operatively connected to a machine exhaust air flow path.

12 Claims, 4 Drawing Sheets

(51) Int. Cl.
*A47L 15/24* (2006.01)
*A47L 15/42* (2006.01)

(52) U.S. Cl.
CPC ..... *A47L 2501/10* (2013.01); *A47L 2501/11* (2013.01); *A47L 2501/12* (2013.01)

(56) References Cited

U.S. PATENT DOCUMENTS

| | | | | |
|---|---|---|---|---|
| 4,657,036 | A | 4/1987 | Yake | |
| 5,167,248 | A | 12/1992 | Tuller | |
| 5,524,358 | A | 6/1996 | Matz | |
| 5,979,472 | A | 11/1999 | Lowery et al. | |
| 8,303,728 | B2 * | 11/2012 | Peukert | A47L 15/486 134/57 D |
| 8,372,214 | B2 * | 2/2013 | Bittner | A47L 15/0081 134/56 D |
| 8,983,668 | B2 | 3/2015 | Ferber et al. | |
| 9,451,870 | B2 | 9/2016 | Delle et al. | |
| 2007/0131260 | A1 | 6/2007 | Scheringer et al. | |
| 2014/0034088 | A1 | 6/2007 | Patdberg | |

* cited by examiner

WAREWASHER MACHINE DRYING SYSTEM AND METHOD

TECHNICAL FIELD

This application relates generally to warewashers such as those used in commercial applications such as cafeterias and restaurants and, more particularly, to a drying system for such warewashers.

BACKGROUND

Commercial warewashers commonly include a housing area which defines washing and rinsing zones for dishes, pots pans and other wares. In conveyor-type machines wares are moved through multiple different spray zones within the housing for cleaning (e.g., pre-wash, wash, post-wash (aka power rinse) and rinse zones). One or more of the zones includes a tank in which liquid to be recirculated for spraying is heated in order to achieve desired cleaning.

Machines may also include a drying zone at the end of the ware path for drying wares as they exit the machine using a flow of heated air from a blower dryer. Generally, the blower dryer air temperatures T should be above a minimum threshold temperature Tmin and below a maximum threshold Tmax, where at least Tmin is desired to have the right temperature for drying and no more than Tmax is desired to ensure the wares are not too hot for handling and to avoid putting too much heat into the room. Blowing sufficient air over the wares helps both drying and the sheeting action of the final rinse water with or without rinse aid. Maintaining the air at desired conditions for drying can be difficult, given that some wares require different temperature air and/or air flows and/or air moisture levels for proper drying, while at the same time assuring that the wares exiting the machine are not too hot to the touch and/or that the drying air exiting the machine does not add too much heat to the ambient environment.

It would be desirable to provide a warewasher drying system that is adaptable to different conditions.

SUMMARY

In one aspect, a warewash machine includes a blower dryer system with air intake paths from each of the room, within the machine and from a machine exhaust flow path.

In another aspect, a warewash machine for washing wares includes a chamber for receiving wares, the chamber having at least one wash zone with an associated spray system for spraying liquid onto wares passing therethrough, wherein a downstream drying zone includes a blower for blowing air onto wares passing therethrough. The blower includes an ambient intake operatively connected to an ambient air flow path, a machine intake operatively connected to an internal machine air flow path and an exhaust intake operatively connected to a machine exhaust air flow path.

In another aspect, a warewash machine for washing wares includes a chamber for receiving wares, the chamber having at least one wash zone with an associated spray system for spraying liquid onto wares passing therethrough. The machine also has a downstream drying zone including a blower for blowing air onto wares passing therethrough. The blower includes multiple air intake flow paths for air from respective sources, wherein at least one air intake flow path is connected to receive air from a hot air exhaust flow path of the machine.

In another aspect, a method of operating a blower dryer of a warewash machine involves: selectively and automatically adjusting intake flows to the blower dryer from each of an ambient room air flow path, an internal machine air flow path and a machine exhaust air flow path so as to achieve one or more characteristics of blower dryer output air.

The details of one or more embodiments are set forth in the accompanying drawings and the description below. Other features, objects, and advantages will be apparent from the description and drawings, and from the claims.

DETAILED DESCRIPTION

Figure 1:
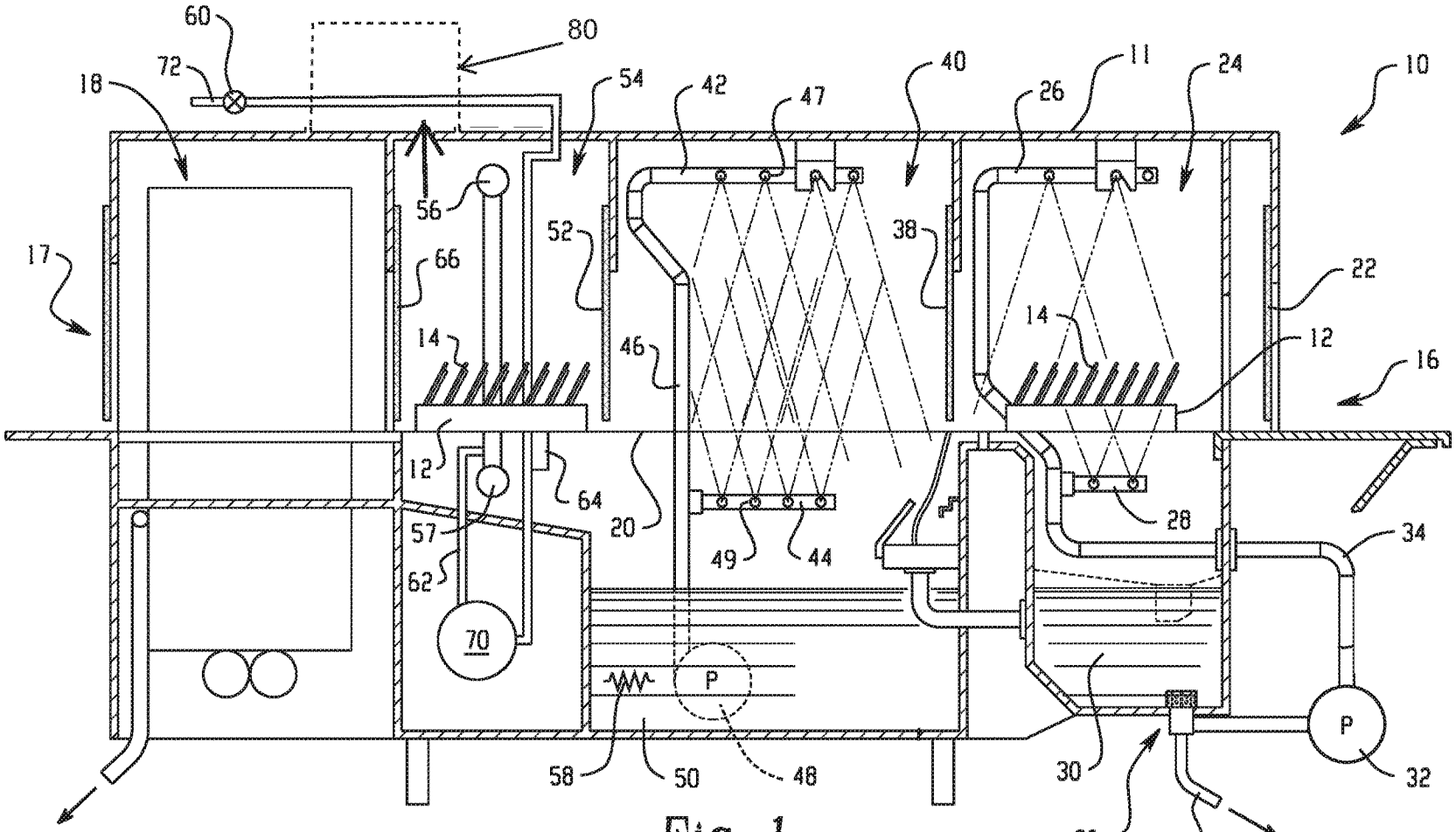
FIG. 1 is a schematic side elevation of one embodiment of a warewasher.

Referring to FIG. 1, an exemplary conveyor-type warewash machine, generally designated 10, is shown. Warewash machine 10 includes a housing 11 that can receive racks 12 of soiled wares 14 from an input side 16. The wares are moved through tunnel-like chambers from the input side toward a blower dryer unit 18 at an opposite exit end 17 of the warewash system by a suitable conveyor mechanism 20. Either continuously or intermittently moving conveyor mechanisms or combinations thereof may be used, depending, for example, on the style, model and size of the warewash system 10. Flight-type conveyors in which racks are not used are also possible. In the illustrated example, the racks 12 of soiled wares 14 enter the warewash system 10 through a flexible curtain 22 into a pre-wash chamber or zone 24 where sprays of liquid from upper and lower pre-wash manifolds 26 and 28 above and below the racks, respectively, function to flush heavier soil from the wares. The liquid for this purpose comes from a tank 30 and is delivered to the manifolds via a pump 32 and supply conduit 34. A drain structure 36 provides a single location where liquid is pumped from the tank 30 using the pump 32. Via the same drain structure, liquid can also be drained from the tank and out of the machine via drain path 37, for example, for a tank cleaning operation.

The racks proceed to a next curtain 38 into a main wash chamber or zone 40, where the wares are subject to sprays of cleansing wash liquid (e.g., typically water with detergent) from upper and lower wash manifolds 42 and 44 with spray nozzles 47 and 49, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse (also known as post-wash) chamber or zone (not shown) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 57 that are supplied with a flow of fresh hot water via pipe 62 running from a hot water booster 70 under the control of a solenoid valve 60 (or alternatively any other suitable valve capable of automatic control). A rack detector 64 may be actuated when a rack 12 of wares 14 is positioned in the final rinse chamber 54 and through suitable electrical controls (e.g., the controller mentioned below), the detector causes actuation of the solenoid valve 60 to open and admit the hot rinse water to the spray heads 56, 57. The water then drains from the wares and is directed into the tank 50 by gravity flow. The rinsed rack 12 of wares 14 then exits the final rinse chamber 54 through curtain 66, moving into dryer unit 18, before exiting the outlet end 17 of the machine.

Figure 2:
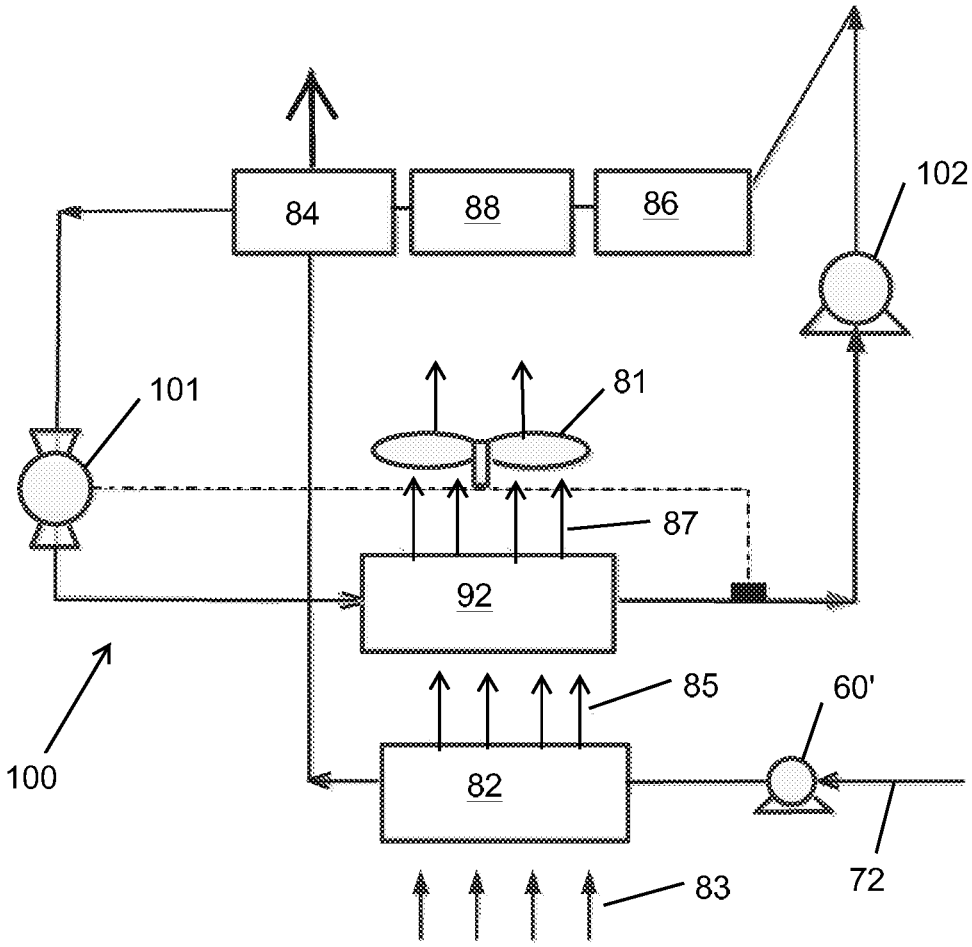
FIG. 2 is a schematic depiction of an exemplary heat recovery system.

An exhaust system 80 for hot moist air may be provided. A cold water input 72 line may run through a waste heat recovery unit (not shown in FIG. 1) associated with the exhaust to recover heat from the exhaust air. Other heat recovery components may also be employed. By way of example, the heat recovery system shown in FIG. 2 may be employed. FIG. 2 shows a machine using a refrigeration or heat pump system to constantly recover waste heat from exhaust for reuse. As shown, the cold water input 72 line may run through a waste heat recovery unit 82 (e.g., a fin-and-tube heat exchanger through which the incoming water flows, though other variations are possible) located in the exhaust air flow path to recover heat from the exhaust air flowing across and/or through the unit 82. The water line or flow path 72 then runs through one or more condensers 84 (e.g., in the form of plate heat exchangers or shell-and-tube heat exchangers, though other variations are possible), before delivering the water to a booster (not shown) for final heating. Additional condensers 86 and 88 may be provided and could be in heat exchange relationship with other machine fluids (e.g., located in the wash tank of the machine). A second waste heat recovery unit 92 may also be provided in the exhaust path. Exhaust blower 81 drives air flow across the heat recovery units.

The flow configuration for both incoming fresh cold water and for refrigerant are shown in FIG. 2. Cold fresh water delivered via a variable flow control pump 60' (or alternatively by the valve 60 of FIG. 1) is first heated by the hot air passing through the waste heat recovery unit 82 (e.g., per arrows 83, 85), then heated further by refrigerant when passing through condenser 84. The refrigerant medium circuit 100 includes a thermal expansion valve 101, which leads to waste heat recovery unit 92 to recover heat from warm waste air (e.g., the exhaust air flow indicated by arrows 85, 87) after some heat has already been removed from the exhaust air flow by unit 82. A compressor 102 compresses the refrigerant to produce superheated refrigerant, which then flows sequentially through the condensers 86, 88, and 84.

In practice, when the energy requirement in one or more of the condensers 84, 86, 88 is satisfied, the system requires the other condensers to utilize the recovered energy, which is almost constant. In the situation of one or more condensers being energy satisfied during operation, excess heat results in the refrigeration circuit, which in turn results in high blower dryer air temperatures (e.g., because waste heat recovery unit 92 does not remove a desired level of heat from the exhaust air stream, which air stream contributes to the blower dryer air flow). In such cases operators may be undesirably exposed to hot blower dryer air and handling of very hot ware at the unloading side of the machine during and after drying.

In addition to excessive heat conditions, as a general rule different wares require different blower air temperatures and flowrates for effective drying. Thus, the blower dryer system described herein can be used in both warewashers including heat recovery systems such as that of FIG. 2, and warewashers that do not include heat recovery systems.

Figure 3:
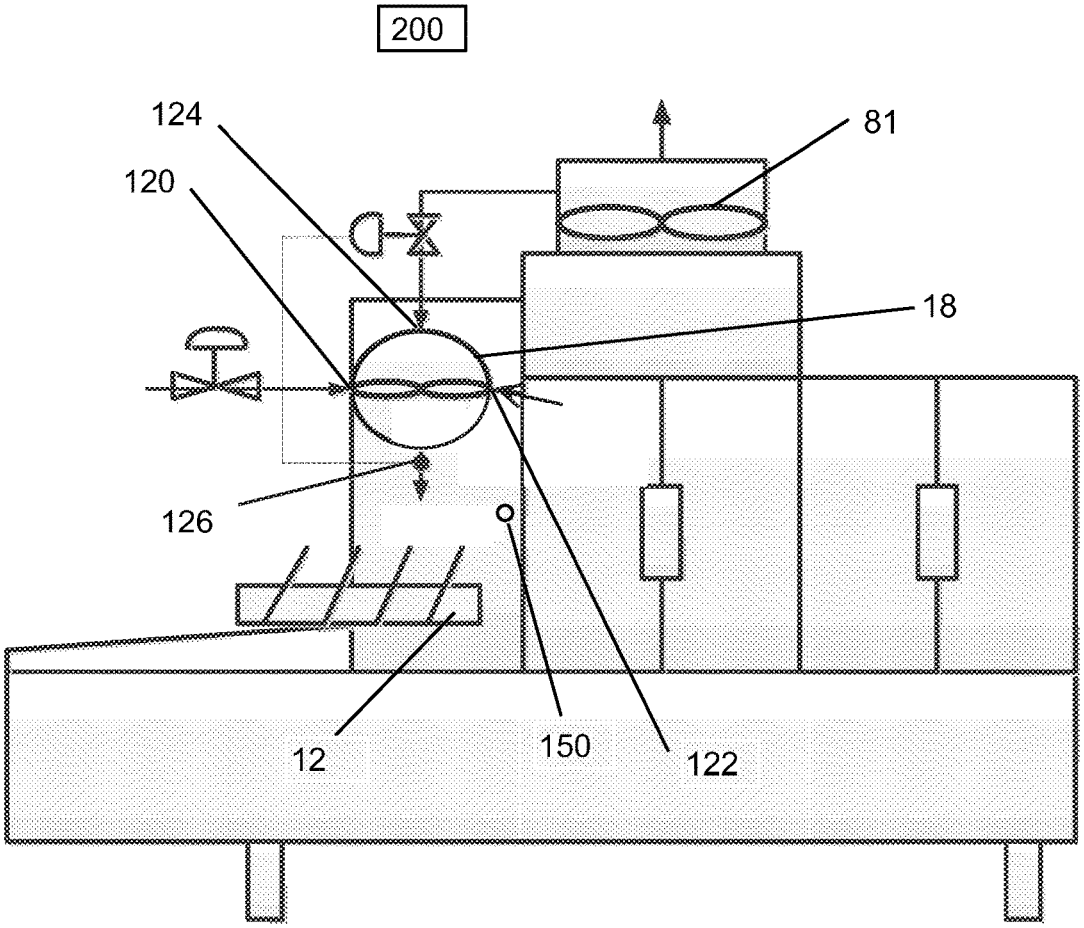
FIG. 3 is schematic depiction of a machine with a blower dryer having multiple input paths.
Figure 4:
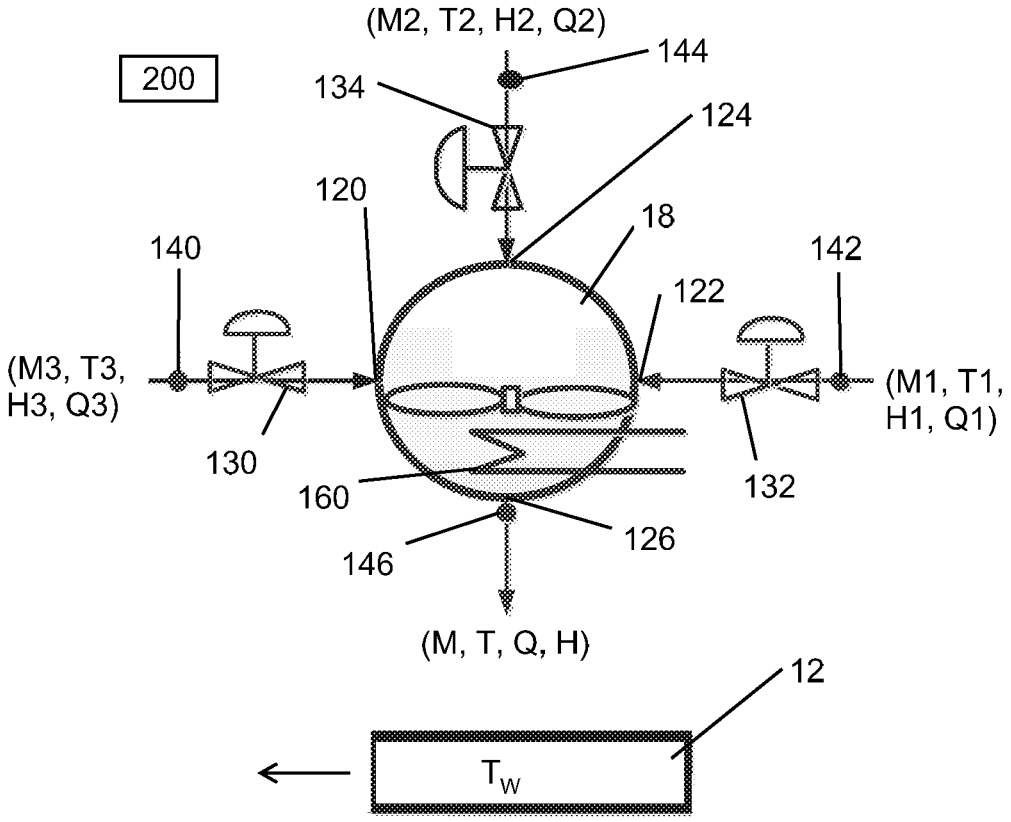
FIG. 4 is a schematic depiction of the multiple input flow paths.

Referring to FIGS. 3 and 4, the blower dryer system 18 includes an ambient air intake 120 from the room and an air intake 122 from internal of the machine. Portions of the exhaust air may also be blended in via intake 124 in order to make use of the heat in the exhaust air. The air from the machine (e.g., from within the tunnel defined by the machine housing) in most cases has higher temperature and humidity compared with the ambient air of the surrounding room. If a constant blower heater system were employed, the lower the blower dryer intake air temperature the lower the blower output air temperature and vice versa. However, the higher the humidity the increased chance of wet wares exiting the machine. Blending of the blower air intakes 120, 122 and/or 124 can be used to achieve desired objectives for the blower output 126 to meet ware dryness and ware temperature (e.g., the blower air temperature, humidity and air flow rate for the ware type and size). Although a variable blower heater could be used to maintain or control the blower air output condition, the inventive blending of the various available intakes leads to energy savings given the various air intake and output conditions desired for different wares.

The blower dryer system 18 can blend room air, hot air from within the machine and machine exhaust from the various intakes 120, 122 and 124 based at least in part upon one or more output characteristics of the blower dryer output air 126. Such characteristics may include blower output air temperature (T), airflow rate (M), humidity (H) and energy (Q) (e.g., as detected by one or more output air sensors 146) and ware dryness or temperature (Tw of ware rack 12). The blower intakes (i.e., room intake air, machine intake air, and machine exhaust) can be controlled manually (e.g., where intake flow control valves 130, 132 and 134 are manual) or automatically (e.g., where intake flow control valves 130, 132 and 134 are automated under control of a controller 200) to achieve the right blower output using manual or automatic baffles or valves. The machine exhaust at intake 124 may be colder or hotter depending on the type of warewash machine (e.g., with our without energy recovery, respectively). In some cases all the exhaust may be channeled to blower intake depending on the ware type or material, or during startup or machine operation to balance the machine to achieve the right blower air temperature and airflow for the necessary ware dryness.

FIG. 4 shows individual blower air intakes with respective air flow temperatures T1, T2, T3, humidity or air quality H1, H2, H3 and energy Q1, Q2, Q3 available to be blended in different proportions (e.g., controllable flow rates M1, M2, M3), all of which may be detected by one or more respective intake air sensors 140, 142, 144, to achieve a desired blower output air characteristic of M, T, H and/or Q. Controlling blower output temperature and energy to desired levels could mean lower or higher intake air temperature is required to assure that the blower output temperature T is within and acceptable range of the desired temperature (e.g., as set by minimum and maximum thresholds of Tmin and Tmax, such that $T_{min} \leq T \leq T_{max}$). Both Tmin and Tmax at a constant blower fan rate are associated with an energy range (e.g., Qmin≤Q≤Qmax). Qmin pertains to wares that require minimal heat or energy for drying while Qmax pertains to wares that require more heat or energy for drying.

From FIG. 4 the following relationships between the individual blower intakes and the blower output hold:

$$M = M1 + M2 + M3 \quad (1)$$

$$Q = M1T1 + M2T2 + M3T3 \quad (2)$$

$$Q = Q1 + Q2 + Q3, \quad (3)$$

$$\text{where } Qi = MiTi \text{ and } Q = \sum_{1}^{n} MiTi,$$

with i representing the various individual blower intake and "n" the number of intakes.

Equation (2) provides the relation between the various blower intake airflow Mi and intake airflow temperatures Ti to achieve the right blower output energy Q. This equation assures that the various ratios of the air intake flow maintain Q within an acceptable range of a desired level (e.g., per Qmin and Qmax, where Qmin≤Q≤Qmax). Generally, it is desired that the air intake 122 from the machine area in FIG. 4 be used, when possible, in the minimum needed to conserve energy in the machine.

To maintain the blower dryer output air energy Q, either the blower output air M increases with low T to maintain Q, which means more of the colder air intake needs to be used, or M is decreased with high T to maintain Q, which means less of the hot air intake needs to be used.

However, there are special cases where Q may need to be below Qmin (Q<Qmin) for drying thermally liable or sensitive wares and/or materials or Q may need to be above Qmax (Q max) for drying some ware types, sizes and/or materials; in these cases either both M and T could be increased or M increased at constant T or T increased at constant M. In most cases, the heating source 160 for the blower dryer is operated at a constant level. The various relations involving temperature T, airflow M, humidity or air quality H, energy Q, etc. and combinations such as heat index in addition to Equation (1), (2) and (3) are applicable.

In an exemplary automatic drying system, all the individual intake blower air conditions (temperature Ti, airflow Mi, humidity Hi) as well as the blower output conditions temperature T, airflow M, humidity H may be sensed for decision making Qi corresponds to the energy of the various intake air sources and Q corresponds to the blower output air calculated using Equation (2). The ware will be sensed (e.g., type and size) and the size used to regulate the blower output conditions such as temperature T, airflow M, humidity H to meet the need including, dryness of the ware; light ware vs heavy wares which require less or more blower output air, respectively; thermally liable ware or heavy wares which require less or more heat, respectively; situations where the blower has to be in a range to satisfy Qmin<Q<Qmax or outside the range to meet the requirement of Q<Qmin and Q>Qmax. The ware size and/or type, and the detected blower output temperature T, airflow M, humidity H, can be used to control the individual intakes 120, 122, 124 to keep the outputs within specified ranges or levels. This means that various intake combinations may be used.

Components 130, 132 134 (e.g., in the form automatic valves as suggested above, or controllable baffles or other flow control structure) are used to control the individual intake air flowrates, e.g., as controlled by a controller 200 that is also connected to sensors 140, 142, 144 and 146. As used herein, the term controller is intended to broadly encompass any circuit (e.g., solid state, application specific integrated circuit (ASIC), an electronic circuit, a combinational logic circuit, a field programmable gate array (FPGA)), processor (e.g., shared, dedicated, or group—including hardware or software that executes code) or other component, or a combination of some or all of the above, that carries out the control functions of the machine or the control functions of any component thereof.

In an alternative embodiment, manual controlling or adjusting of the baffles/valves to achieve the blower output requirement given the type of ware, balancing machine, etc. may be implemented. In this case, components 130, 132, 134 represent manual valves or baffles used to control the individual airflow rates.

Dryer systems according to the above concept(s) may provide one or more of: (1) variable air intake conditions with constant or fixed blower dryer heater energy to meet the need; constant or fixed air intake conditions with variable blower dryer heater energy to meet the need; (2) sensing individual blower intake air conditions (temperatures T1, T2, T3, airflows M1, M2, M3, humidity levels H1, H2, H3) corresponding to energies Q1, Q2, Q3, as well as the blower output temperature T, airflow M, humidity H corresponding to energy Q for decision making to control the individual blower air intakes to achieve any of: Qmin≤Q≤Qmax (normal range), Q<Qmin (for thermally liable ware or material), Q>Qmax (for heavier ware), comparing the various individual intake air conditions to make decisions on what intake proportions to use to meet the objectives (e.g., including dryness, light ware wanting less blower output air, heavy wares which could handle higher blower air output for dryness, thermally liable ware or material wanting low blower output temperature, heavy ware wanting less blower output air and the combinations); (3) sensing ware type and size (e.g., per ware type and/or size sensor 150) for decisions that establish whether to control the intakes according to Qmin≤Q≤Qmax, Q<Qmin or Q>Qmax; (4) variable blower output based on lightness of the ware; (5) sensing humidity of the blower output to increase the airflow of the hottest intake to result in drier ware or increase the blower heater energy to dry the air; and/or (6) system use to enhance machine adaptation to the various operational phases (e.g., initial start-up, continuous operation and start-up from idling).

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application.

What is claimed is:

1. A conveyor-type warewash machine through which wares are conveyed for washing, comprising:

a chamber for receiving the wares, the chamber having at least one spray zone with an associated spray system with a plurality of nozzles for spraying liquid onto the wares passing through the spray zone, wherein a downstream drying zone is located within the chamber and includes a blower with an output within the chamber for blowing air onto the wares passing through the drying zone;

wherein the blower includes multiple separate intakes, including an ambient intake operatively connected to an ambient air flow path to receive air from outside of the chamber, a machine intake operatively connected to an internal machine air flow path to receive air from inside the chamber prior to the air being exhausted from the chamber and an exhaust intake operatively connected to a machine exhaust air flow path, such that the output of the blower can separately receive distinct air flows from each of the ambient intake, the machine intake and the exhaust intake;

wherein each of the ambient air flow path, the internal machine air flow path and the machine exhaust air flow path includes a respective adjustable flow control device for varying an amount of air traveling therealong;

wherein each adjustable flow control device is automatically and selectively adjustable under control of a controller.

2. The machine of claim 1 wherein the ambient air flow path includes an intake air sensor, the internal machine air flow path includes an intake air sensor and the machine exhaust air flow path includes an intake air sensor for detecting one or more conditions of incoming air.

3. The machine of claim 2 wherein the blower includes an air output having at least one output air sensor for detecting one or more output air conditions.

4. The machine of claim 3 wherein the controller is operatively connected to each of the intake air sensor of the ambient air flow path, the intake air sensor of the internal machine air flow path, the intake air sensor of the machine exhaust air flow path and the output air sensor, and the controller is configured to monitor incoming air condition of each flow path and responsively control each adjustable flow control device to aid in achieving one or more particular blower output air conditions.

5. The machine of claim 4, further comprising at least one sensor for detecting ware type and/or size, and the controller is configured to determine or define the one or more particular blower output air conditions based at least in part upon ware type and/or size.

6. A conveyor-type warewash machine through which wares are conveyed for washing, comprising:

a chamber for receiving the wares, the chamber having at least one spray zone with an associated spray system with a plurality of nozzles for spraying liquid onto the wares passing through the spray zone, wherein a downstream drying zone is located within the chamber and includes a blower with an output within the chamber for blowing air onto the wares passing through the drying zone, wherein the blower includes multiple air intake flow paths for air from respective sources, including a first intake flow path that is connected to receive air from a hot air exhaust flow path of the machine, such that the output of the blower can receive the air from the hot air exhaust flow path and reintroduce the air form the hot air exhaust flow path into drying zone of the chamber.

7. The machine of claim 6, further comprising:

at least one air intake sensor located for detecting one or more conditions of incoming air of the first intake flow path; and at least one air output sensor located for detecting one or more conditions of output air from the blower.

8. The machine of claim 7, further comprising:

an adjustable flow control device associate with the first intake flow path; and a controller operatively connected to the air intake sensor, the air output sensor and the adjustable flow control device, wherein the controller is configured to monitor incoming air condition of the first intake air flow path and, based at least in part upon the incoming air condition, to control the adjustable flow control device to aid in achieving one or more particular output air conditions.

9. The machine of claim 8, further comprising at least one sensor for detecting ware type and/or size, wherein the controller is configured to determine or define the one or more particular output air conditions based at least in part upon ware type and/or size.

10. The machine of claim 6, wherein the multiple intake flow paths further include a second intake flow path for receiving ambient air from outside the chamber.

11. The machine of claim 6, wherein the multiple intake flow paths further include a second intake flow path for receiving air from within the chamber before the air enters the hot air exhaust flow path.

12. The machine of claim 6, wherein the multiple intake flow paths further include a second intake flow path for receiving ambient air from outside the chamber and a third intake flow path for receiving air from within the chamber before the air enters the hot air exhaust flow path.

* * * * *